US006283191B1

(12) United States Patent
Lo

(10) Patent No.: US 6,283,191 B1
(45) Date of Patent: Sep. 4, 2001

(54) MOTORIZED WINDOW BLIND

(76) Inventor: May-Chang Lo, 4F, No. 21, Tung-Ya-Nan Rd., Hsiaokang Dist., Kaohsiung City (TW)

( * ) Notice: Subject to any disclaimer, the term of this patent is extended or adjusted under 35 U.S.C. 154(b) by 0 days.

(21) Appl. No.: 09/477,315

(22) Filed: Jan. 4, 2000

(51) Int. Cl.[7] ..... A47H 5/00

(52) U.S. Cl. ..... 160/84.02; 160/84.06; 160/265; 160/370.23

(58) Field of Search ..... 160/265, 266, 160/80, 45, 240, 243, 71, 84.06, 370.22, 370.23, 84.04, 84.02; 135/88.1, 88.11, 88.12, 141; 49/121, 123

(56) References Cited

U.S. PATENT DOCUMENTS 1,272,958 * 7/1918 Hunt .
5,172,745 * 12/1992 Wang .
5,813,450 * 9/1998 Yang .

FOREIGN PATENT DOCUMENTS

2594480 * 9/1987 (FR) .

* cited by examiner

*Primary Examiner*—Blair M. Johnson
(74) *Attorney, Agent, or Firm*—Mechant & Gould P.C.

(57) ABSTRACT

A motorized window blind includes a mounting frame stretched in a longitudinal direction, a blind screen including a mounted end mounted on the mounting frame, a liftable end opposite to the mounted end in a transverse direction relative to the longitudinal direction, and a flexible intermediate portion interposed therebetween. A motor has an output shaft and is mounted in the vicinity of the mounting frame so as to drive a drive transmitting member to move a distal end of the drive transmitting member in the transverse direction between retracted and extended positions where the distal end is proximate and distal to the mounting frame, respectively. A plurality of tubes are telescopically fitted to each other, and extend in the transverse direction. The tubes include a tail end fixedly mounted relative to the mounting frame, and a lead end opposite to the tail end in the transverse direction and disposed to associate the liftable end with the distal end to move the liftable end when the lead end is driven by the distal end.

9 Claims, 10 Drawing Sheets

MOTORIZED WINDOW BLIND

BACKGROUND OF THE INVENTION

1. Field of the Invention

This invention relates to a motorized window blind, more particularly to a motorized window blind which has telescopically fitted tubes driven by a motor to extend and retract a blind screen.

2. Description of the Related Art

Referring to FIG. 1, a conventional window blind 1 is shown to include a mounting frame 11, and a blind screen 10 which has a mounted end secured on the mounting frame 11, a liftable end 12, and an intermediate portion with a plurality of sheet portions 101. Right and left guiding threads 111, 112 have ends which are connected to a spring 13 received in the mounting frame 11, and weave through the sheet portions 101 via holes 113 formed therein. The other end of the left guiding thread 111 passes through a left friction member 14, and then extends along the liftable end 12 to enter a right friction member 15 so as to be fixed on a right fixing member 17. Likewise, the other end of the right guiding thread 112 passes through the right friction member 15, and then extends along the liftable end 12 to enter the left friction member 14 so as to be fixed on a left fixing member 16. By means of the friction of the friction members 14, 15, the liftable end 12 can be moved manually to extend and retract the blind screen 10, and can be maintained at a predetermined level.

However, when the conventional window blind 1 is mounted on a relatively high window, the moving operation of the liftable end 12 is difficult to conduct.

SUMMARY OF THE INVENTION

The object of the present invention is to provide a motorized window blind which can be operated conveniently.

According to this invention, the motorized window blind includes a mounting frame with right and left bracket parts spaced apart from each other in a longitudinal direction, and a blind screen. The blind screen includes a mounted end mounted on the mounting frame and including first right and left side portions respectively proximate to the right and left bracket parts, a liftable end opposite to the mounted end in a transverse direction relative to the longitudinal direction and including second right and left side portions opposite to each other in the longitudinal direction, and a flexible intermediate portion interposed between the mounted and liftable ends. A motor has an output shaft and is mounted in the vicinity of the mounting frame. A drive transmitting member has a distal end, and is driven by the output shaft to move the distal end in the transverse direction between retracted and extended positions where the distal end is proximate and distal to the mounting frame, respectively. A plurality of tubes are telescopically fitted to each other. The tubes are disposed between the first right and left side portions, and extend in the transverse direction. The tubes include a tail end fixedly mounted relative to the mounting frame, and a lead end opposite to the tail end in the transverse direction and disposed to associate the liftable end with the distal end to move the liftable end when the lead end is driven by the distal end.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
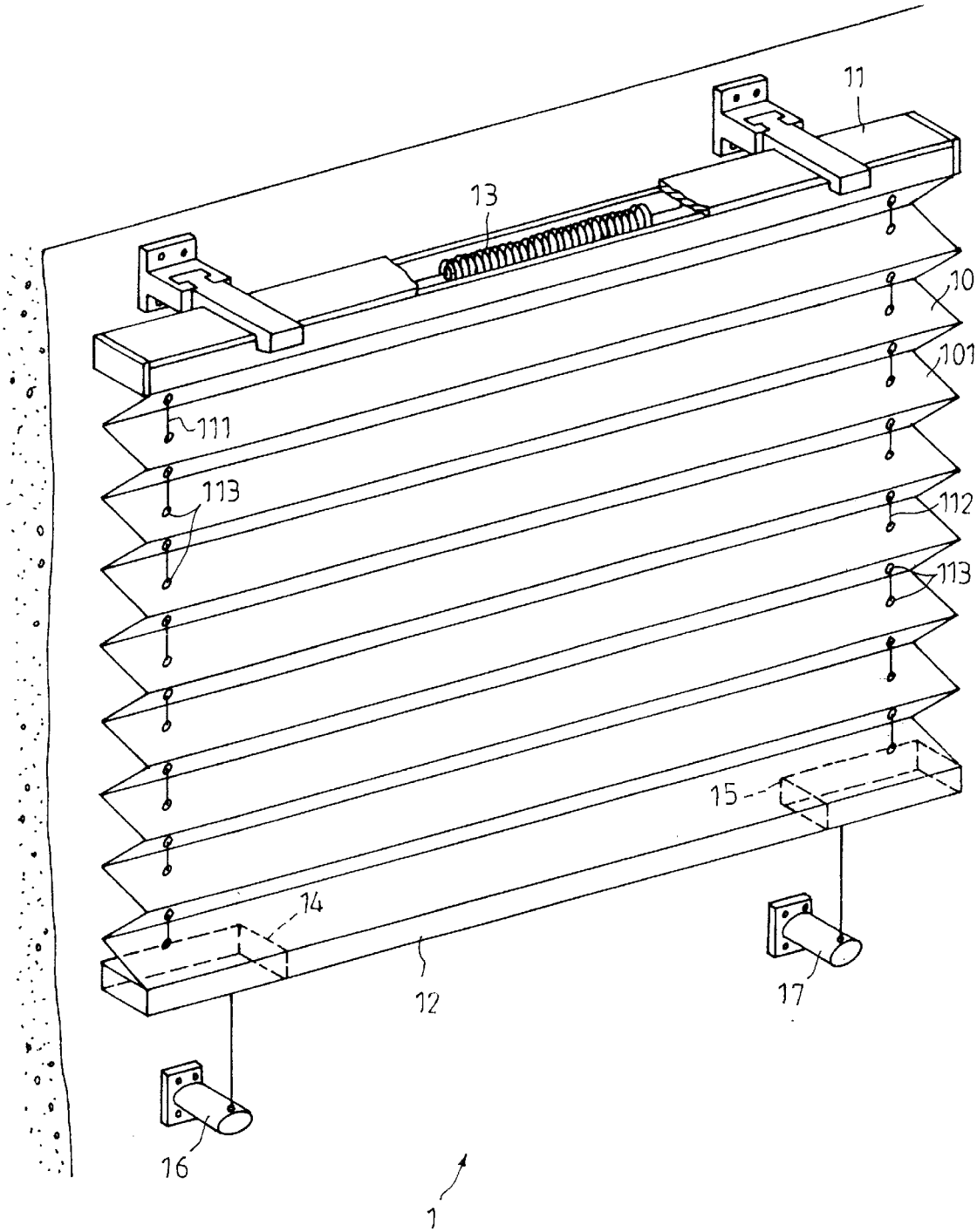
FIG. 1 PRIOR ART
FIG. 1 is a perspective view of a conventional motorized window blind.
Figure 2:
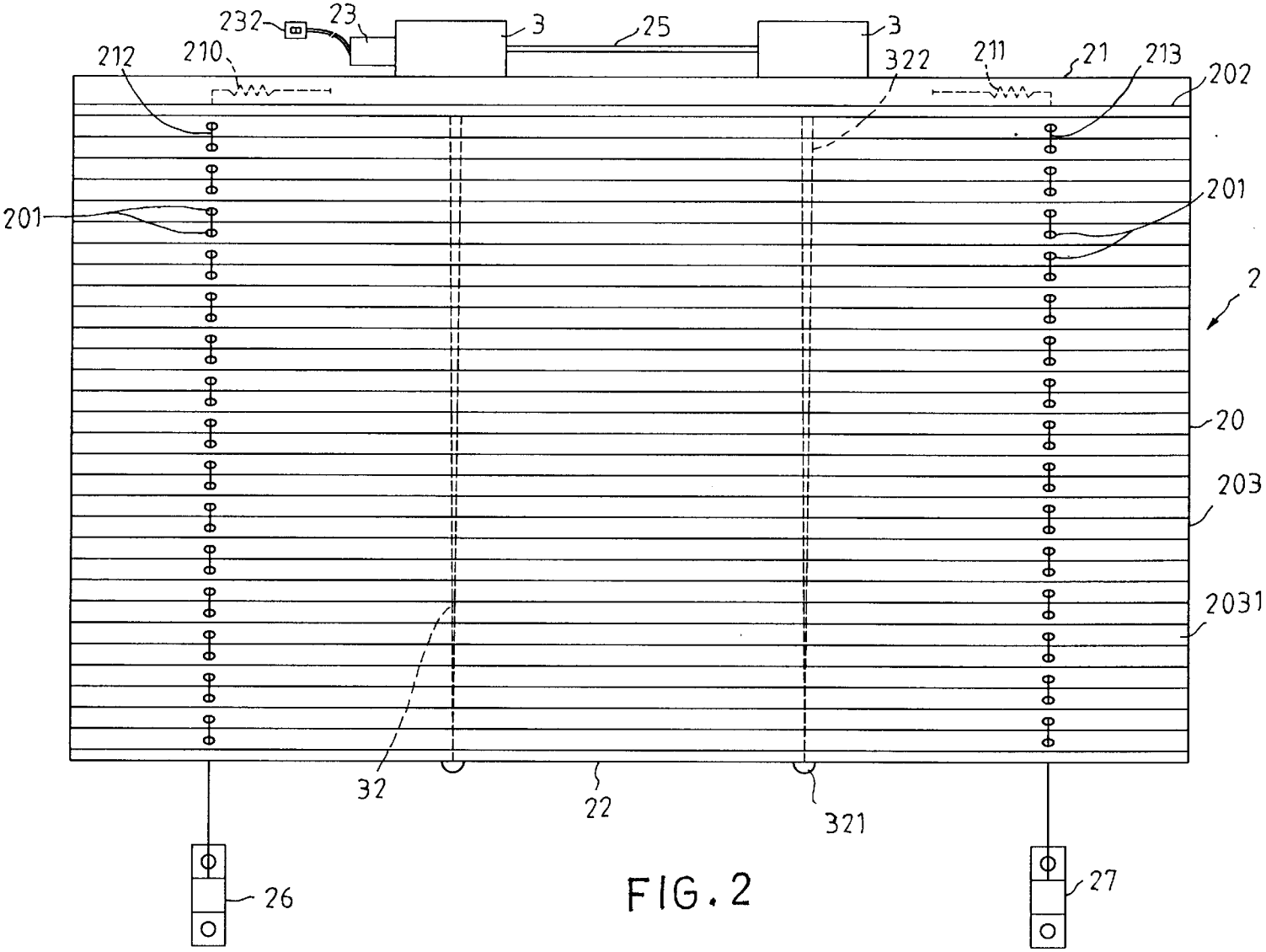
FIG. 2 is a schematic view of a first preferred embodiment of a motorized window blind according to this invention.

Referring to FIG. 2, the first preferred embodiment of the motorized window blind 2 according to the present invention is shown to comprise a mounting frame 21, a blind screen 20, a motor 23, two drive transmitting members 3, and right and left assemblies of tubes 32.

Figure 3:
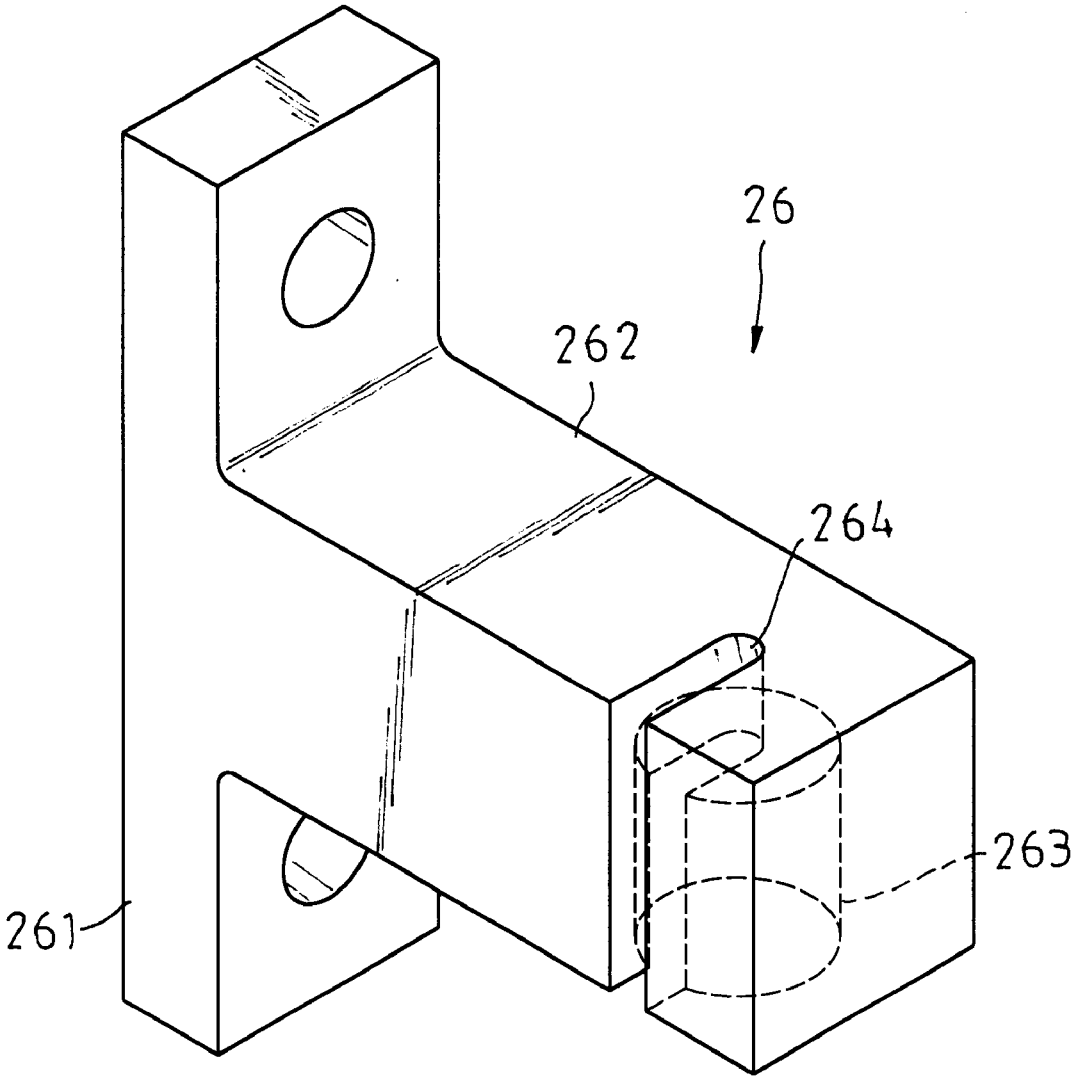
FIG. 3 is a perspective view of a fixing member of the motorized window blind according to the first preferred embodiment.

The mounting frame 21 includes right and left bracket parts spaced apart from each other in a longitudinal direction. Two springs 210, 211 are disposed in and are secured to the mounting frame 21 at ends, and are connected to two guiding threads 212, 213 at the other ends. The guiding threads 212, 213 are further secured to two fixing members 26, 27. With reference to FIG. 3, the fixing member 26 is shown to include a seat portion 261 and a jut portion 262 projecting from the seat portion 261. The jut portion 262 is formed with a retaining groove 263 with a lower opening, and an elongated slot 264 communicated with the retaining groove 263 such that the respective guiding thread 212 can be retained in the retaining groove 263 through the elongated slot 264. As such, the fixing members 26, 27 and the springs 210, 211 serve as two tensing members to keep the guiding threads 212, 213 in a tensed state in the transverse direction.

The blind screen 20 includes a mounted end 202 which is mounted on the mounting frame 21 and which is stretched in the longitudinal direction, a liftable end 22 which is stretched in the longitudinal direction and which is opposite to the mounted end 202 in a transverse direction relative to the longitudinal direction, and a flexible intermediate portion 203 which is interposed between the mounted end 202 and the liftable end 22. The mounted end 202 and the liftable end 22 include first and second right and left side portions opposite to each other in the longitudinal direction and proximate to the right and left bracket parts, respectively. In this preferred embodiment, the intermediate portion 203 includes a plurality of fold lines spaced apart from each other in the transverse direction to divide the intermediate portion 203 into a plurality of sheet portions 2031 that configure the intermediate portion 203 in a form of accordion pleats. The sheet portions 2031 have two sets of holes 201 such that the guiding threads 213 are brought to weave through the sheet portions 2031 via the holes 201.

Figure 4:
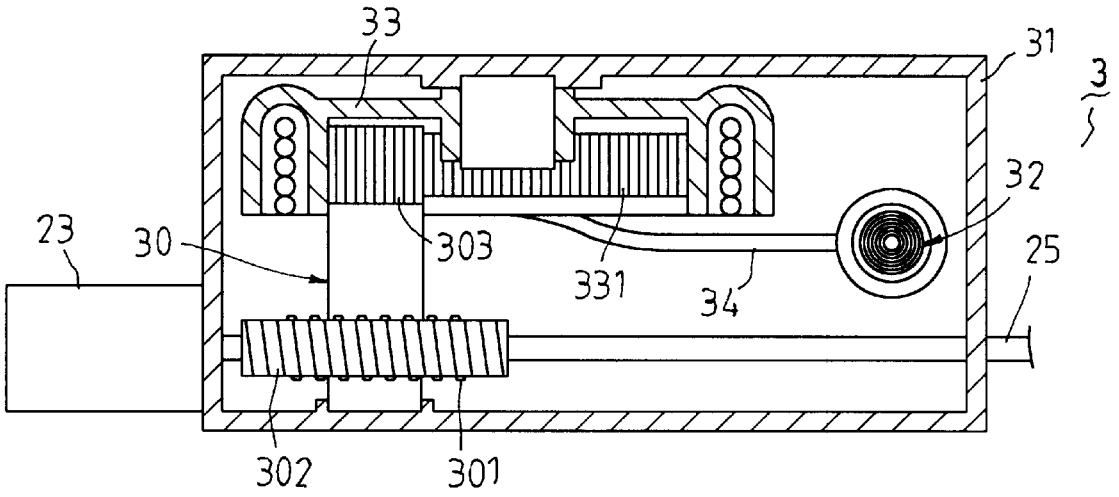
FIG. 4 is a longitudinal sectional view of a drive transmitting member and an assembly of tubes according to the first preferred embodiment.
Figure 5:
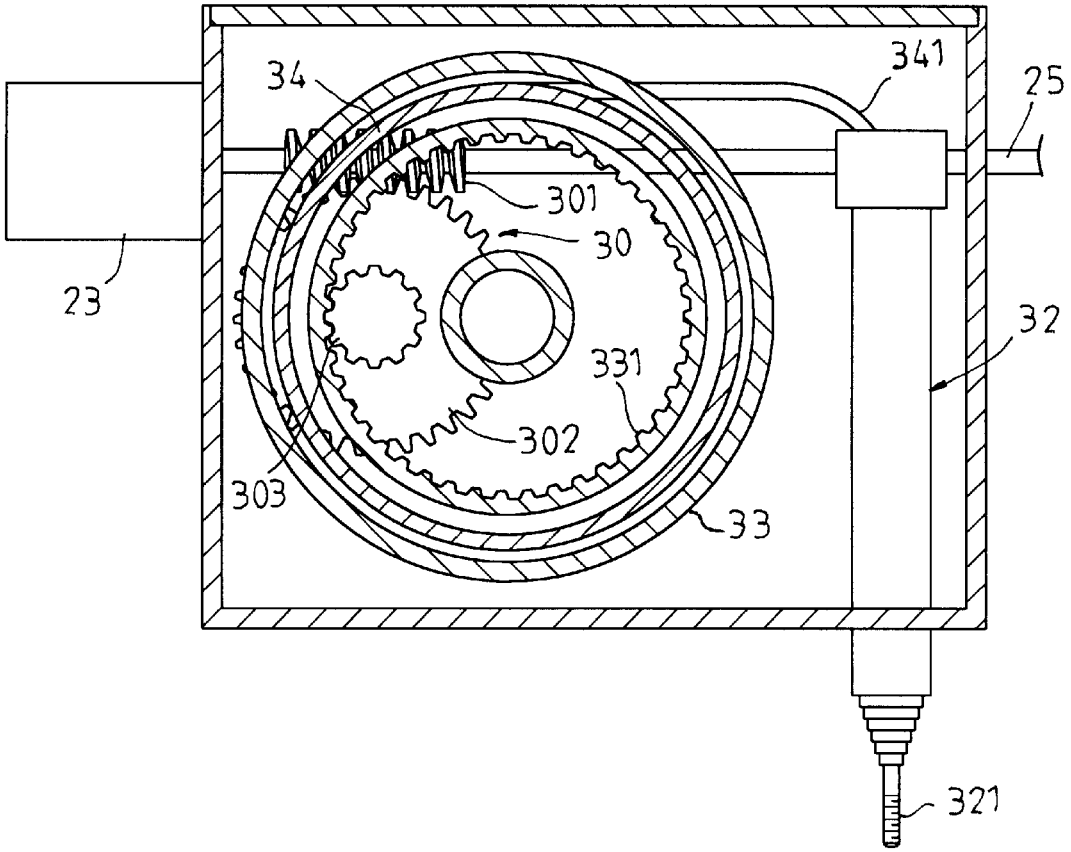
FIG. 5 is a cross-sectional view of the drive transmitting member and the assembly of tubes when the assembly of tubes is in a retracted state.

Referring to FIGS. 4 and 5, in combination with FIG. 2, the motor 23 and the drive transmitting members 3 are mounted on the mounting frame 21. The motor 23 is connected to a switch controller 232 which can be suitably located to ease operation for actuating an output shaft (not shown). One drive transmitting member 3 is disposed to be driven by the output shaft of the motor 23, and is connected to the other drive transmitting member 3 via a connecting shaft 25 so as to achieve simultaneous operation of the drive transmitting members 3. Each drive transmitting member 3 includes a housing 31, a reel 33 which is received in the housing 31 and which is rotated by the output shaft of the motor 23, and a transmitting thread 34 which is disposed in the reel 33 for movement along with the rotation of the reel 33, and which has a distal end 341 that is disposed outwardly of the reel 33 and that can be moved in the transverse direction between retracted and extended positions, where the distal end 341 is proximate and distal to the reel 33, respectively. The tubes 32 of each assembly are telescopically fitted to each other in the transverse direction, and include a tail end 322 which is mounted fixedly on the housing 31, and a lead end 321 which is disposed opposite to the tail end 322 in the transverse direction. The distal end 341 of the transmitting thread 34 is brought to pass into the tail end 322 and through the telescopically fitted tubes 32 so as to be associated with the lead end 321. In addition, the lead end 321 is associated with the liftable end 22 so as to move the liftable end 22 when the lead end 321 is driven by the distal end 341 of the transmitting thread 34.

Figure 6:
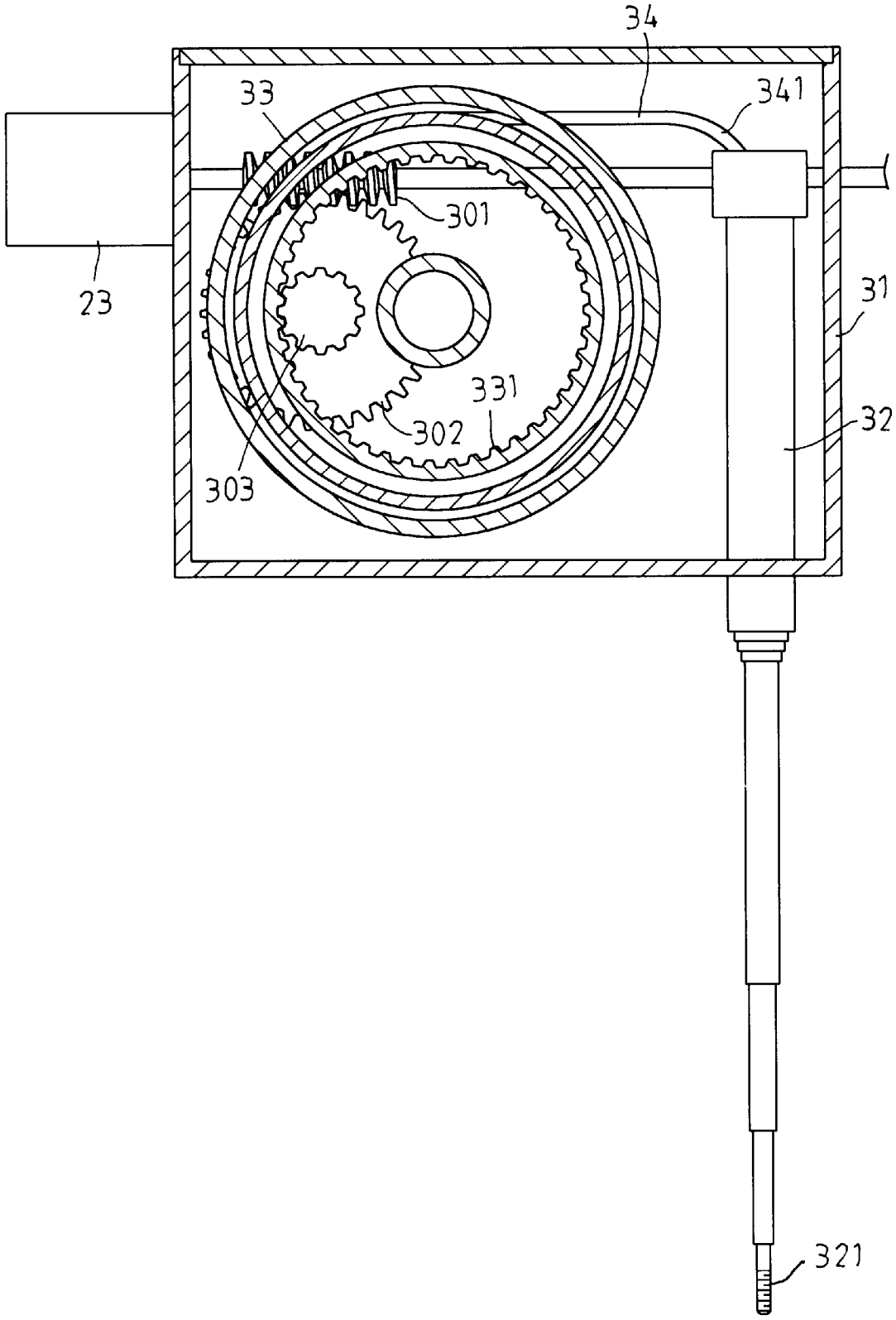
FIG. 6 is a cross-sectional of the drive transmitting member and the assembly of tubes when the assembly of tubes is in an extended state.

A gear train 30 is interposed between the output shaft of the motor 23 and the drive transmitting member 3 to modulate the driven speed of the drive transmitting member 3. The gear train 30 includes an inner circumferential teeth portion 331 which is formed on an inner circumferential wall of the reel 33, a worm 301 and a worm gear 302 driven by the output shaft of the motor 23, and a pinion 303 which is disposed on the worm gear 302 and which engages the inner circumferential teeth portion 331. As such, with reference to FIG. 6, the output shaft of the motor 23 drives the two worms 301 in the two housings 31 simultaneously to rotate the worm gears 302 as well as the pinions 303 so as to rotate the reels 33 for moving the liftable end 22, along with the distal ends 341 of the transmitting threads 34, in the transverse direction.

As mentioned above, the user merely operates the switch controller 232 to actuate the motor 23 so as to extend and retract the right and left assemblies of tubes 32 simultaneously, thereby resulting in convenience when operating the blind screen 20. In addition, the guiding threads 213 serve as stabilizing members to maintain the second right and left side portions of the liftable end 22 at the same level when the liftable end 22 is being moved by the lead ends 321.

Figure 8:
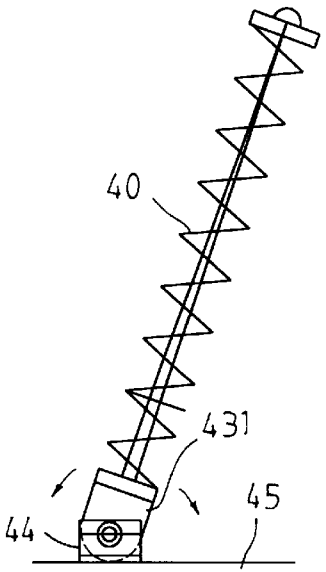
FIG. 8 is a side view of the motorized window blind of the second preferred embodiment.
Figure 7:
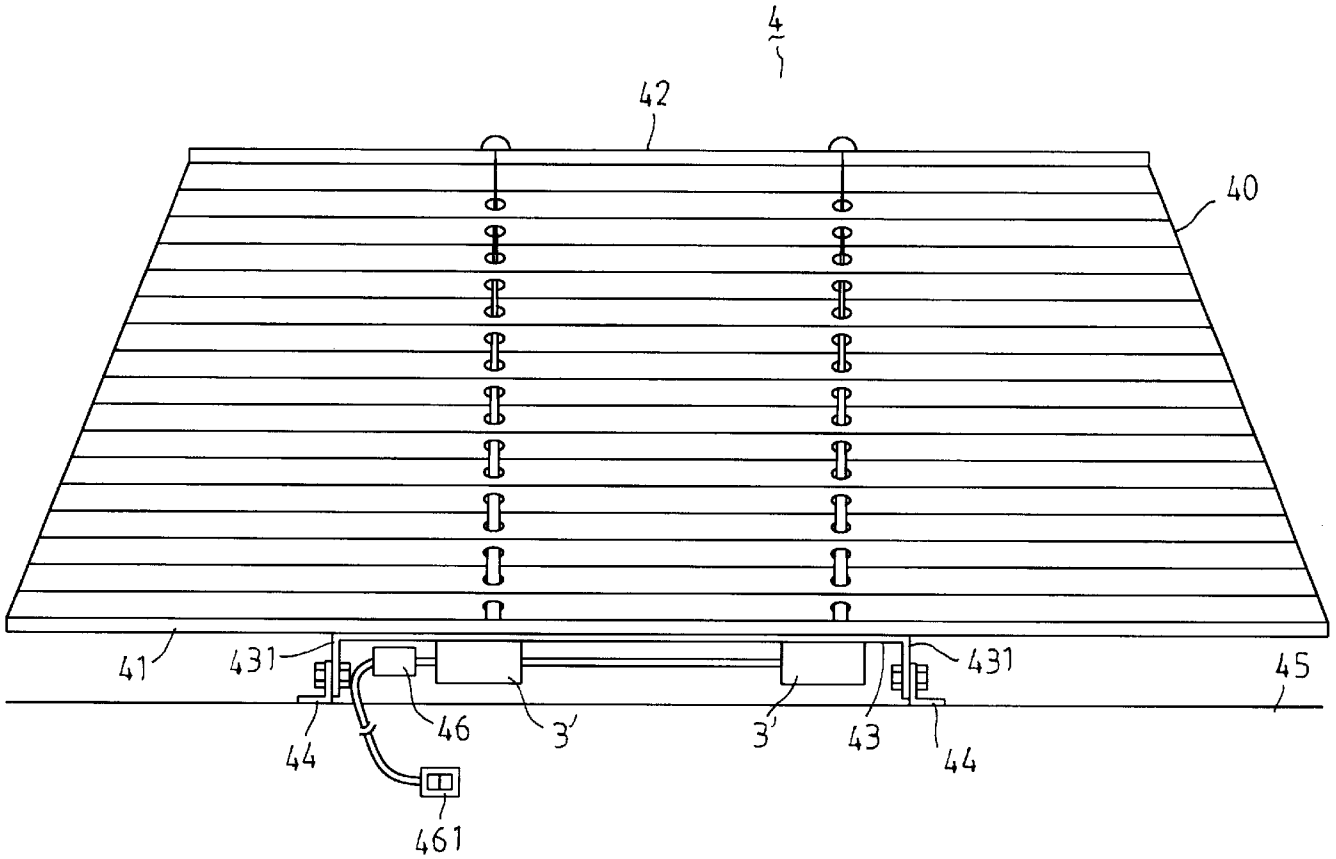
FIG. 7 is a schematic view of a second preferred embodiment of a motorized window blind according to this invention.

Referring to FIGS. 7 and 8, the second preferred embodiment of the motorized window blind 4 is mounted on a rear windshield of a vehicle. The motorized window blind 4 includes a blind screen 40 which has a mounted end 41 and a liftable end 42 opposite to the mounted end 41 in the transverse direction, a motor 46 which is connected to a switch controller 461, two drive transmitting members 3' which are driven by the output shaft of the motor 46, right and left seat frames 44 which are adapted to be secured on a support wall 45 adjacent to the rear windshield, right and left bracket parts 43 which are secured to the mounted end 41 and which have connecting plates 431 mounted pivotally on the right and left seat frames 44 about a pivot axis parallel to the longitudinal direction such that the blind screen 40 can be inclined relative to the seat frames 44 to suit a variety of vehicles. The switch controller 461 may be mounted adjacent to the driver seat of the vehicle for convenience during operation.

Figure 9:
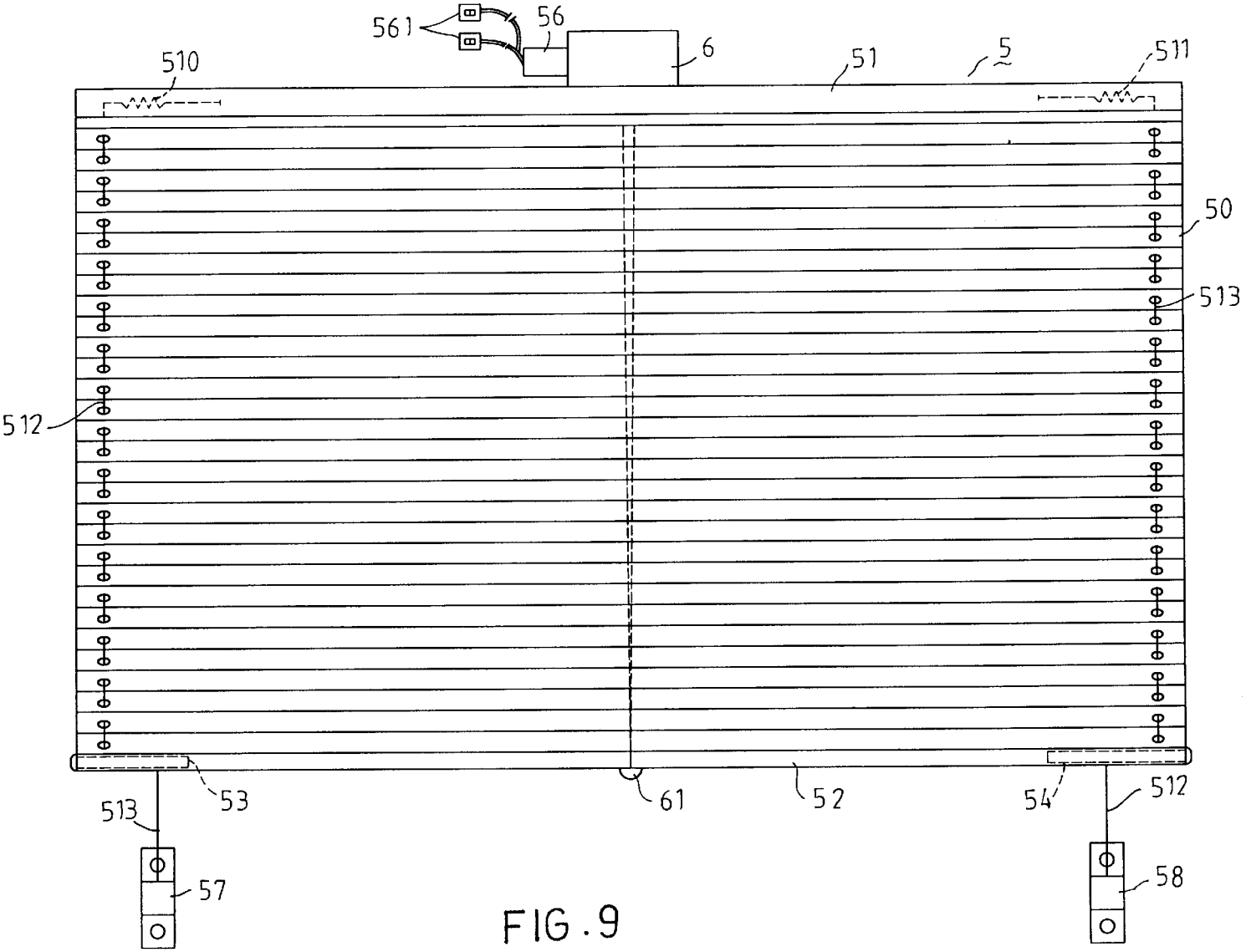
FIG. 9 is a schematic view of a third preferred embodiment of a motorized window blind according to this invention.
Figure 10:
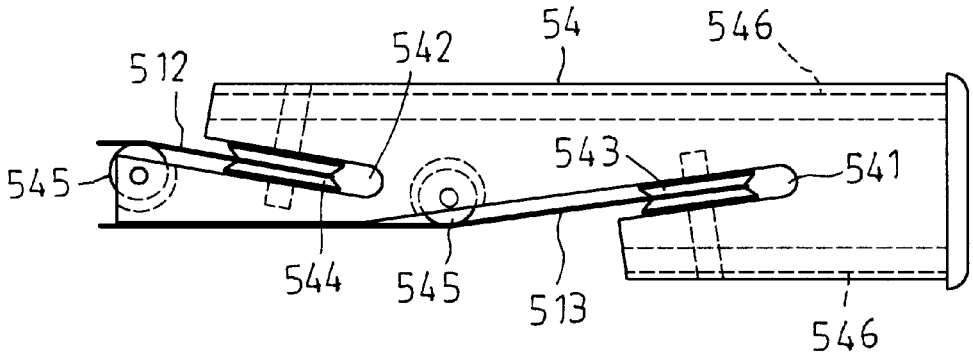
FIG. 10 is a sectional view of a tensing member of the motorized window blind according to the third preferred embodiment.
Figure 11:
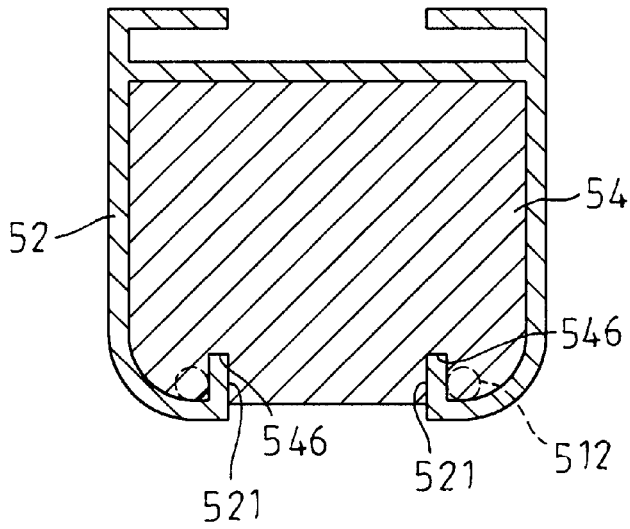
FIG. 11 is a cross-sectional view of a liftable end of a blind screen according to the third preferred embodiment.

Referring to FIG. 9, the third preferred embodiment of the motorized window blind 5 according to this invention is shown to include one assembly of telescopically fitted tubes 61 and one drive transmitting member 6. In addition, right and left friction members 53, 54 are disposed on the liftable end 52 of the blind screen 50. With reference to FIGS. 10 and 11, the right friction member 54 has first and second notches 541, 542, first and second pulleys 543, 544 which are mounted in the notches 541, 542, and first and second guiding wheels 545. Two elongated grooves 546 are formed in a lower end of the friction member 54 so as to engage two engaging portions 521 of the liftable end 52. Left and right guiding threads 512, 513 have ends which are connected to a spring 510, 511 mounted in the mounted frame 51, and which weave through the sheet portions of the blind screen 50. The other end of the right guiding thread 513 is disposed in the first notch 541 around the pulley 543 and the guiding wheel 545, and extends outwardly of the right friction member 54 along the liftable end 52 to the second notch (not shown) of the left friction member 53 so as to be secured to a left fixing member 57. In the same way, the other end of the left guiding thread 512 is disposed in the first notch (not shown) of the left friction member 53, and extends along the liftable end 52 to enter the second notch 542 of the right friction member 54 around the guiding wheel 545 and the pulley 544 so as to be secured to a right fixing member 58. A motor 56 is mounted on the mounting frame 56, and is connected to two switch controllers 561 which may be located at two different places. With the presence of the right and left friction members 53, 54 and the guiding threads 512, 513, the retracted and extended operations of the blind screen 50 can be ensured.

Figure 12:
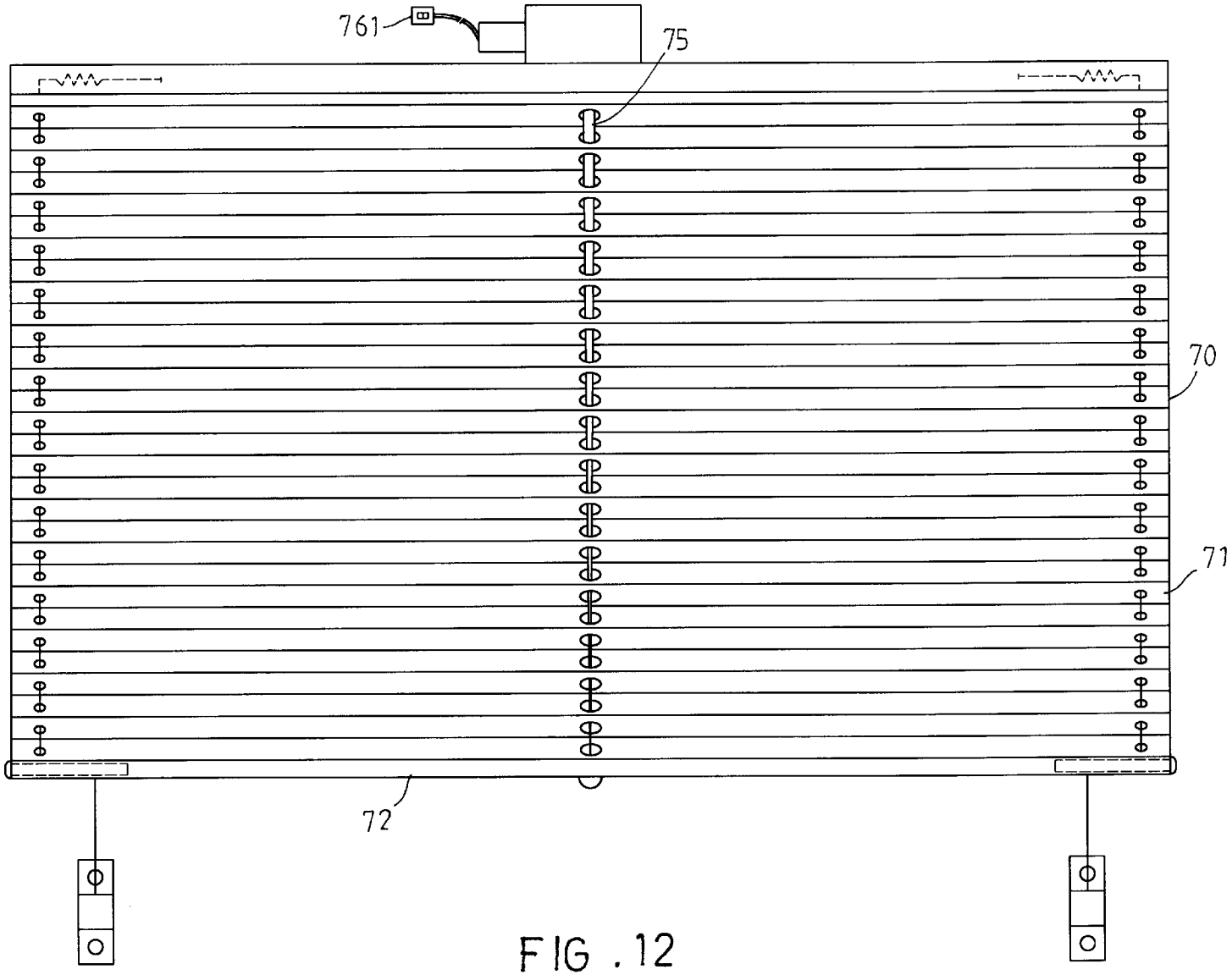
FIG. 12 is a schematic view of a fourth preferred embodiment of a motorized window blind according to this invention.

Referring to FIG. 12, the fourth preferred embodiment of the motorized window blind is similar to the third preferred embodiment shown in FIG. 9 in construction, and includes a blind screen 70 driven by a motor actuated by a switch controller 761 to operate a liftable end 72 between retracted and extended positions. In addition, the assembly of the telescopically fitted tubes 75 is disposed to pass through each consecutive one of the sheet portions 71 of the blind screen 70 crosswise and in a weaving manner with the sheet portions 71.

Figure 13:
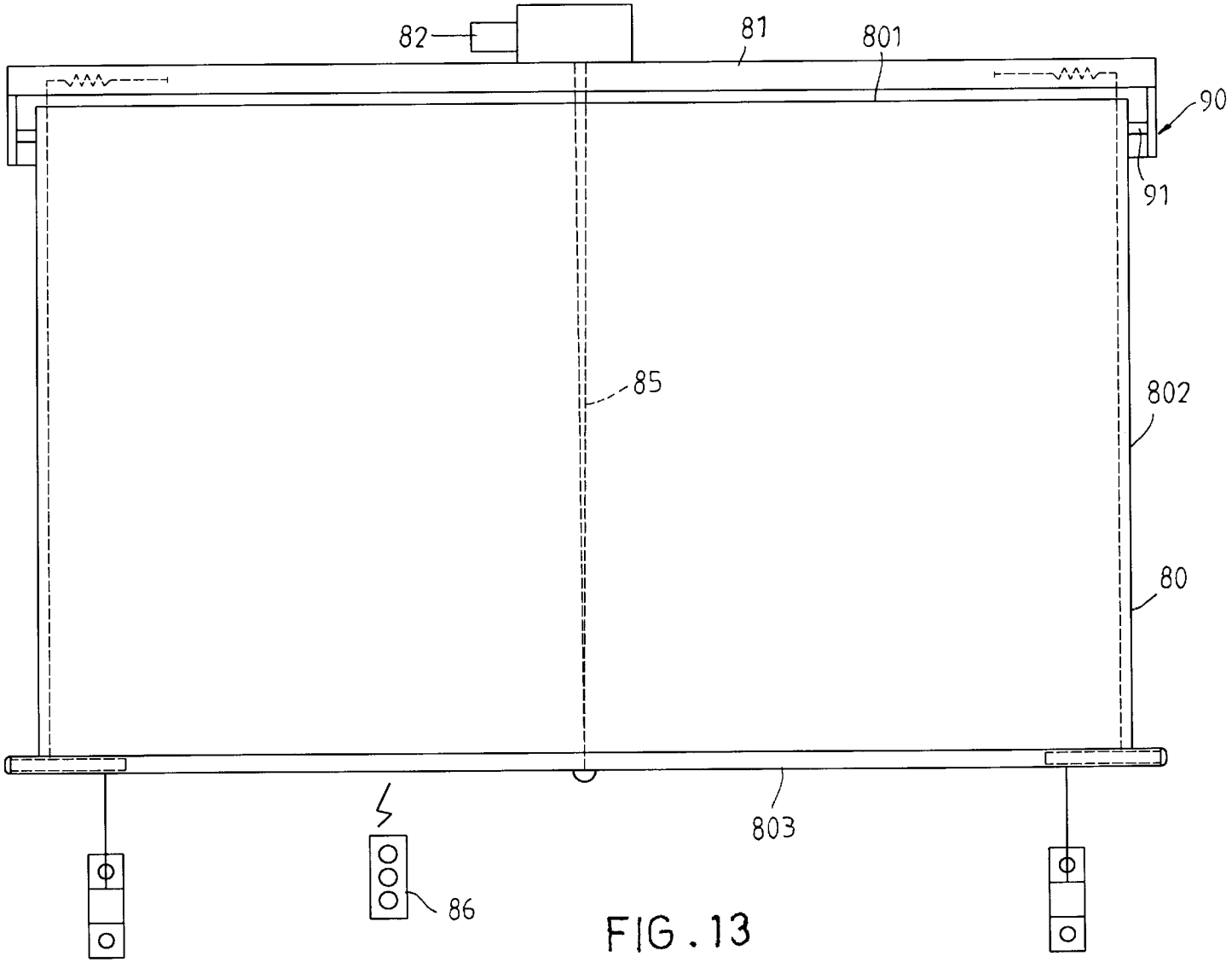
FIG. 13 is a schematic view of a fifth preferred embodiment of a motorized window blind according to this invention.

Referring to FIG. 13, the fifth preferred embodiment of the motorized window blind is similar to the third preferred embodiment shown in FIG. 9 in construction, and includes a mounting frame 81, a blind screen 80, a motor 82, a drive transmitting member 83, and a switch controller 86. The blind screen 80 is a single piece of a cloth. A roller 90 is mounted on the mounting frame 81, and includes right and left journalled ends 91 opposite to each other in the longitudinal direction and respectively journalled on the right and left bracket parts of the mounting frame 81. The mounted end 801 of the blind screen 80 is mounted on the roller 90 between the right and left journalled ends 91 such that the intermediate portion 802 of the blind screen 80 is reeled out and taken up by the roller 90 when the liftable end 803 is being moved by the lead end of the tubes 85. The switch controller 86 may be in a form of a remote controller.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A motorized window blind comprising:

a mounting frame including right and left bracket parts spaced apart from each other in a longitudinal direction;

a blind screen including a mounted end disposed to be mounted on said mounting frame and extended in the longitudinal direction, said mounted end including first right and left side portions opposite to each other in the longitudinal direction and proximate to said right and left bracket parts, respectively, a liftable end disposed to be extended in the longitudinal direction and opposite to said mounted end in a transverse direction relative to the longitudinal direction, said liftable end including second right and left side portions opposite to each other in the longitudinal direction, and an intermediate portion which is flexible and which is interposed between said mounted and elevated ends;

a motor having an output shaft and mounted in the vicinity of said mounting frame;

a drive transmitting member having a distal end, and disposed to be driven by said output shaft to move said distal end in the transverse direction between retracted and extended positions where said distal end is proximate and distal to said mounting frame, respectively; and a plurality of tubes telescopically fitted to each other, disposed between said first right and left side portions, and extending in the transverse direction, said tubes including a tail end fixedly mounted relative to said mounting frame, and a lead end opposite to said tail end in the transverse direction and disposed to associate said liftable end with said distal end to move said liftable end when said lead end is driven by said distal end.

2. The motorized window blind as claimed in claim 1, wherein said intermediate portion includes a plurality of fold lines spaced apart from each other in the transverse direction to divide said intermediate portion into a plurality of sheet portions that configure said intermediate portion in a form of accordion pleat.

3. The motorized window blind as claimed in claim 2, wherein said distal end is brought to pass into said tail end and through said telescopically fitted tubes so as to be associated with said lead end.

4. The motorized window blind as claimed in claim 3, wherein the assembly of said telescopically fitted tubes is disposed to pass through each consecutive one of said sheet portions crosswise and in a weaving manner with said sheet portions.

5. The motorized window blind as claimed in claim 4, further comprising right and left seat frames adapted to be mounted on a support, said right and left bracket parts being pivotally mounted on said right and left seat frames about a pivot axis which is parallel to the longitudinal direction.

6. The motorized window blind as claimed in claim 1, further comprising a gear train interposed between said output shaft and said drive transmitting member to modulate speed of said drive transmitting member.

7. The motorized window blind as claimed in claim 6, further comprising a pair of stabilizing members, each disposed adjacent to a respective one of said second right and left side portions in the longitudinal direction so as to maintain said second right and left side portions at the same level when said liftable end is being moved by said lead end.

8. The motorized window blind as claimed in claim 7, wherein each of said stabilizing members includes a guiding thread which is brought to weave through said plurality of sheet portions between respective ones of said first and second right and left side portions, said motorized window blind further comprising a pair of tensing members each disposed to keep said guiding thread in a tensed state in the transverse direction so as to provide a guiding action to said sheet portions when said liftable end is being moved by said lead end.

9. A motorized window blind according to claim 1, further comprising a roller including right and left journalled ends opposite to each other in the longitudinal direction and respectively journalled on said right and left bracket parts, wherein said mounted end is mounted on said roller between said right and left journalled ends such that said intermediate portion is reeled out or taken up by said roller when said liftable end is being moved by said lead end.

* * * * *